US012313262B2

(12) United States Patent
Kim et al.

(10) Patent No.: US 12,313,262 B2
(45) Date of Patent: May 27, 2025

(54) NOZZLE ASSEMBLY, COMBUSTOR, AND GAS TURBINE INCLUDING SAME

(71) Applicant: DOOSAN ENERBILITY CO., LTD., Changwon (KR)

(72) Inventors: Hokeun Kim, Daejeon (KR); Youngjun Shin, Yongin (KR); Eunyoung Kim, Seoul (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/487,128

(22) Filed: Oct. 16, 2023

(65) Prior Publication Data

US 2024/0175579 A1 May 30, 2024

(30) Foreign Application Priority Data

Nov. 30, 2022 (KR) ..... 10-2022-0164596

(51) Int. Cl.
*F23R 3/14* (2006.01)
*F23R 3/28* (2006.01)

(52) U.S. Cl.
CPC . *F23R 3/14* (2013.01); *F23R 3/28* (2013.01)

(58) Field of Classification Search
CPC ..... F23R 3/14; F23R 3/28
See application file for complete search history.

(56) References Cited

U.S. PATENT DOCUMENTS

| | | | | |
|---|---|---|---|---|
| 6,993,916 | B2 * | 2/2006 | Johnson | F23R 3/14 60/737 |
| 7,673,454 | B2 * | 3/2010 | Saito | F02C 3/14 60/737 |
| 8,316,645 | B2 * | 11/2012 | Lee | F23R 3/14 60/737 |
| 8,959,921 | B2 * | 2/2015 | Khan | F23R 3/14 60/737 |
| 11,668,466 | B2 * | 6/2023 | Chon | F23R 3/286 60/722 |
| 2006/0191268 | A1 * | 8/2006 | Widener | F23D 14/48 60/740 |
| 2007/0151255 | A1 | 7/2007 | Johnson | |

(Continued)

FOREIGN PATENT DOCUMENTS

| | | | |
|---|---|---|---|
| JP | 11-311415 | A | 11/1999 |
| KR | 10-2019-0054817 | A | 5/2019 |
| KR | 10-2020-0038699 | A | 4/2020 |

(Continued)

*Primary Examiner* — Lorne E Meade
(74) *Attorney, Agent, or Firm* — Harvest IP Law, LLP

(57) ABSTRACT

Proposed are a nozzle assembly, a combustor, and a gas turbine including the same. The nozzle assembly mixes compressed air supplied from a compressor of the gas turbine with fuel supplied from the outside, and ejects a mixture of the compressed air and the fuel to a combustion chamber of the combustor. The nozzle assembly includes a nozzle flange receiving the fuel from the outside, a nozzle shroud, a first main cylinder forming a first main flow path, a first swirler, a second main cylinder forming a second main flow path, and a second swirler. The nozzle flange includes a plurality of fuel supply flow paths, and a supplied fuel is distributed to the first swirler and the second swirler along the fuel supply flow paths.

10 Claims, 12 Drawing Sheets

(56) References Cited

U.S. PATENT DOCUMENTS

| | | | | |
|---|---|---|---|---|
| 2013/0186094 | A1 | 7/2013 | Parsania | |
| 2022/0003167 | A1 * | 1/2022 | Shershnyov | F23R 3/16 |

FOREIGN PATENT DOCUMENTS

| | | | | | |
|---|---|---|---|---|---|
| KR | 20200038699 | A | * | 4/2020 | F23R 3/14 |
| KR | 10-2126883 | B1 | | 6/2020 | |
| KR | 10-2162053 | B1 | | 10/2020 | |
| KR | 10-2189308 | B1 | | 12/2020 | |
| KR | 10-2322596 | B1 | * | 11/2021 | F23R 3/14 |
| KR | 10-2343001 | B1 | | 12/2021 | |
| KR | 10-2343002 | B1 | | 12/2021 | |

* cited by examiner

NOZZLE ASSEMBLY, COMBUSTOR, AND GAS TURBINE INCLUDING SAME

CROSS REFERENCE TO RELATED APPLICATION

The present application claims priority to Korean Patent Application No. 10-2022-0164596, filed on Nov. 30, 2022, the entire contents of which are incorporated herein for all purposes by this reference.

BACKGROUND OF THE INVENTION

1. Field of the Invention

Embodiments of the present disclosure relate to a nozzle assembly, a combustor, and a gas turbine including the same. More particularly, embodiments of the present disclosure relate to a nozzle assembly, a combustor, and a gas turbine including the nozzle assembly and the combustor that are capable of reducing NOx by improving fuel-air mixing characteristics.

2. Description of the Background Art

Generally, a gas turbine includes a compressor, a combustor, and a turbine. The compressor includes a plurality of compressor vanes and a plurality of compressor blades which are alternately provided in a compressor casing. In addition, the compressor is configured to intake external air through a compressor inlet scroll strut. The intaken air is compressed by the compressor vanes and the compressor blades while passing through an inner portion of the compressor.

The combustor receives compressed air that is compressed in the compressor, and mixes the compressed air with fuel. In addition, the combustor ignites fuel mixed with compressed air by using an igniter, thereby generating high-temperature and high-pressure combustion gas. Such generated combustion gas is supplied to the turbine.

The turbine includes a plurality of turbine vanes and a plurality of turbine blades which are alternately provided in a turbine casing. In addition, the turbine receives combustion gas generated at the combustor, and passes the combustion gas through an inner portion of the turbine. Combustion gas passing through the inner portion of the turbine rotates the turbine blades, and combustion gas that has completely passed through the inner portion of the turbine is discharged to the outside of the turbine through a turbine diffuser.

The gas turbine further includes a tie rod. The tie rod is mounted such that the tie rod passes through center portions of compressor disks and center portions of turbine disks, in which the compressor blades are coupled to outer circumferential surfaces of the compressor disks and the turbine blades are coupled to outer circumferential surfaces of the turbine disks. Accordingly, the tie rod is configured such that the compressor disks and the turbine disks are fixed inside the gas turbine.

Such a gas turbine does not have a reciprocating mechanism such as a piston which is usually provided in a typical four-stroke engine, so that the gas turbine has no mutual friction portion such as a piston-cylinder, thereby having an advantage that consumption of lubricant is extremely low. Therefore, the gas turbine is advantageous in that an amplitude of vibration, which is a characteristic of reciprocating machines, is significantly reduced, and high-speed operation is possible to produce high-capacity power.

Meanwhile, in a conventional gas turbine, as fuel is directly ejected from swirl vanes forming a vortex to introduced compressed air, there is a problem that the compressed air and the fuel are not uniformly mixed.

SUMMARY OF THE INVENTION

Accordingly, the present disclosure has been made keeping in mind the above problems occurring in the related art, and an objective of the present disclosure is to provide a nozzle assembly, a combustor, and a gas turbine capable of reducing NOx by improving fuel-air mixing characteristics.

The technical problems that are intended to be addressed in the present disclosure are not restricted to the above described problems, and other problems, which are not mentioned herein, could be clearly understood by those of ordinary skill in the art from details described below.

According to an embodiment of the present disclosure, there is provided a nozzle assembly including: a nozzle flange configured to receive fuel from outside; a nozzle shroud disposed on a first side of the nozzle flange; a first main cylinder disposed inside the nozzle shroud in a radial direction of the nozzle shroud, the first main cylinder forming a first main flow path between the nozzle shroud and the first main cylinder; a first swirler mounted on the first main cylinder; a second main cylinder disposed inside the first main cylinder in a radial direction of the first main cylinder, the second main cylinder forming a second main flow path between the first main cylinder and the second main cylinder; and a second swirler mounted on the second main cylinder, wherein a plurality of fuel supply flow paths is formed in the nozzle flange, and a supplied fuel is distributed to the first swirler and the second swirler along the plurality of fuel supply flow paths.

Preferably, the plurality of fuel supply flow paths may include a plurality of first fuel supply flow paths supplying the fuel to the first swirler and a plurality of second fuel supply flow paths supplying the fuel to the second swirler, and the first fuel supply flow paths may be disposed to be spaced apart from each other by a predetermined distance in a circumferential direction and the second fuel supply flow paths may be disposed to be spaced apart from each other by a predetermined distance in the circumferential direction.

Preferably, the amount of fuel distributed to the first fuel supply flow paths and the second fuel supply flow paths may be determined by the sum of respective flow path areas.

Preferably, the first swirler may be provided with an angle inclined in the circumferential direction, and the second swirler may be arranged in a straight line in an axial direction.

Preferably, the first main cylinder may be disposed such that a first side end portion of the first main cylinder is shorter than a first side end portion of the second main cylinder.

Preferably, a second side end portion of the nozzle shroud may be provided with a curved surface.

Preferably, a perforated plate may be disposed in a second side end portion of the first main cylinder.

Preferably, a cooling air inlet flow path may be formed in the nozzle flange, and cooling air introduced through the cooling air inlet flow path may be moved to the second main cylinder.

Preferably, a bluff body may be provided at a first side end portion of the second main cylinder, and a plurality of bluff body cooling holes may be formed in the bluff body.

Preferably, the bluff body cooling holes may be inclined.

Preferably, a collision plate provided with a plurality of collision plate cooling holes may be disposed inside the bluff body.

In addition, according to the present disclosure, there is provided a combustor configured to mix compressed air with fuel and to combust a mixture of the compressed air and the fuel, and the combustor including: a nozzle casing; a liner connected to an end portion of the nozzle casing, the liner having an inner portion provided with a combustion chamber in which the mixture of the compressed air and the fuel is combusted; a transition piece connected to an end portion of the liner, the transition piece being configured to supply the combustion gas generated from the combustion chamber to the turbine; and a nozzle assembly mounted inside the nozzle casing and configured to eject the fuel and the compressed air into the combustion chamber, wherein the nozzle assembly includes: a nozzle flange configured to receive fuel from outside; a nozzle shroud disposed on a first side of the nozzle flange; a first main cylinder disposed inside the nozzle shroud in a radial direction of the nozzle shroud, the first main cylinder forming a first main flow path between the nozzle shroud and the first main cylinder; a first swirler mounted on the first main cylinder; a second main cylinder disposed inside the first main cylinder in a radial direction of the first main cylinder, the second main cylinder forming a second main flow path between the first main cylinder and the second main cylinder; and a second swirler mounted on the second main cylinder, wherein a plurality of fuel supply flow paths is formed in the nozzle flange, and a supplied fuel is distributed to the first swirler and the second swirler along the plurality of fuel supply flow paths.

In addition, according to the present disclosure, there is provided a gas turbine including: a compressor configured to compress air introduced from outside; a combustor configured to mix compressed air supplied from the compressor with fuel and to combust a mixture of the compressed air and the fuel; and a turbine configured to generate power for generating electric power by passing combustion gas supplied from the combustor to an inner portion of the turbine, wherein the combustor includes: a nozzle casing; a liner connected to an end portion of the nozzle casing, the liner having an inner portion provided with a combustion chamber in which the mixture of the compressed air and the fuel is combusted; a transition piece connected to an end portion of the liner, the transition piece being configured to supply the combustion gas generated from the combustion chamber to the turbine; and a nozzle assembly mounted inside the nozzle casing and configured to eject the fuel and the compressed air into the combustion chamber, wherein the nozzle assembly includes: a nozzle flange configured to receive fuel from the outside; a nozzle shroud disposed on a first side of the nozzle flange; a first main cylinder disposed inside the nozzle shroud in a radial direction of the nozzle shroud, the first main cylinder forming a first main flow path between the nozzle shroud and the first main cylinder; a first swirler mounted on the first main cylinder; a second main cylinder disposed inside the first main cylinder in a radial direction of the first main cylinder, the second main cylinder forming a second main flow path between the first main cylinder and the second main cylinder; and a second swirler mounted on the second main cylinder, and wherein a plurality of fuel supply flow paths is formed in the nozzle flange, and a supplied fuel is distributed to the first swirler and the second swirler along the plurality of fuel supply flow paths.

According to an embodiment, there is an effect that NOx is reduced by improving fuel-air mixing characteristics in a radial direction.

Various and beneficial advantages and effects of the present disclosure are not limited to the above, and will be more easily understood in the course of describing specific embodiments of the present disclosure.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
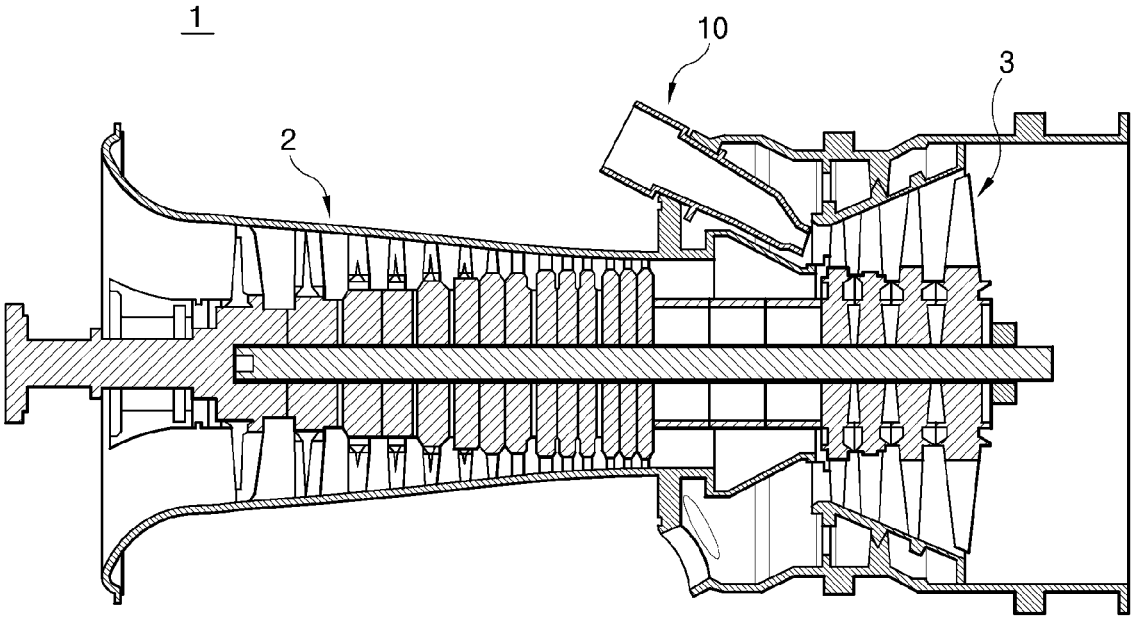
FIG. 1 is a cross-sectional view illustrating a gas turbine according to the present disclosure.

Hereinafter, exemplary embodiments of the present disclosure will be described in detail with reference to the accompanying drawings.

However, the technical spirit of the present disclosure is not limited to some of the described embodiments, but may be implemented in various different forms, and as long as it is within the scope of the technical spirit of the present disclosure, one or more of the elements may be selectively combined and substituted between the embodiments.

In addition, terms (including technical and scientific terms) used in the embodiments of the present disclosure may be generally understood by those of ordinary skilled in the art to which the present disclosure belongs, unless specifically defined and described explicitly, and terms commonly used, such as terms defined in the dictionary, may be interpreted in consideration of the contextual meaning of the related art.

In addition, the terms used in the embodiments of the present disclosure are for describing the embodiments, and are not intended to limit the present disclosure.

In this specification, a singular form may also include a plural form unless otherwise specified in a phrase, and when it is described as 'at least one (or one or more) of A and (with) B, C', it may include one or more of all possible combinations of A, B, and C.

In addition, in describing the components of the embodiment of the present disclosure, terms such as first, second, A, B, (a), (b), and so on may be used.

These terms are only for distinguishing the component from other components, and are not limited to the essence, order, or sequence of the component by the terms.

In addition, when one component is referred to as being 'connected', 'coupled', or 'contacted' to another component, it should be understood that the component is directly connected, coupled, or contacted to the other component or is 'connected', 'coupled', or 'contacted' to the other component via another component therebetween.

In addition, when one component is referred to as being formed or disposed on 'upper (above) or lower (below)' of each component, the upper (above) or lower (below) includes not only the case where two components are in direct contact with each other, but also a case where one or more other components are formed or disposed between the two components. In addition, when expressed as 'upper (above) or lower (below)', the meaning of not only the upper direction but also the lower direction based on one component may be included.

Hereinafter, embodiments of the present disclosure will be described in detail with reference to the accompanying drawings, and in the description with reference to the accompanying drawings, the same or corresponding components are given the same reference numbers, regardless of reference numerals in drawings, and an overlapped description therewith will be omitted.

FIGS. 1 to 10B clearly illustrate only main features for conceptually and clearly understanding the present disclosure. As a result, various modifications of the drawings are expected, and the scope of the present disclosure need not be limited to particular shapes illustrated in the drawings.

Hereinafter, a nozzle assembly, a combustor, and a gas turbine including the same according to an embodiment of the present disclosure will be described with reference to the accompanying drawings.

FIG. 1 is a cross-sectional view illustrating a gas turbine according to the present disclosure.

Referring to FIG. 1, a gas turbine 1 of the present disclosure includes a compressor 2, a combustor 10, and a turbine 3. On the basis of a flow direction of gas (compressed air or combustion gas), the compressor 2 is disposed at an upstream side of the gas turbine 1, and the turbine 3 is disposed at a downstream side of the gas turbine 1. In addition, the combustor 10 is disposed between the compressor 2 and the turbine 3.

The compressor 2 accommodates compressor vanes and compressor rotors in a compressor casing, and the turbine 3 accommodates turbine vanes and turbine rotors in a turbine casing. The compressor vanes and the compressor rotors are disposed in a multi-stage structure along the flow direction of compressed air, and the turbine vanes and the turbine rotors are also disposed in a multi-stage structure along the flow direction of combustion gas. Here, the compressor 2 is designed such that an internal space thereof is gradually decreased in size from a front stage to a rear stage so that air intaken into the compressor 2 can be compressed. In contrast, the turbine 3 is designed such that an internal space thereof is gradually increased in size from a front stage to a rear stage so that combustion gas supplied from the combustor 10 can expand.

Meanwhile, a torque tube functioning as a torque transmission member for transmitting rotational torque generated from the turbine 3 to the compressor 2 is disposed between the compressor rotor that is positioned at the rearmost stage of the compressor 2 and the turbine rotor that is positioned at the foremost stage of the turbine 3. As illustrated in FIG. 1, the torque tube may include a plurality of torque tube disks arranged in a three-stage structure, but this is only one of various embodiments of the present disclosure. Furthermore, the torque tube may include a plurality of torque tube disks arranged in a structure of equal to or more than four stages or a structure of equal to or less than two stages.

Each compressor rotor includes a compressor disk and compressor blades. In the compressor casing, a plurality (e.g., fourteen) of compressor disks is provided, and each of the compressor disks is coupled by a tie rod such that the compressor disks are not spaced apart from each other in an axial direction. In more detail, with the tie rod passing through each center portion of the compressor disks, each of the compressor disks is arranged along the axial direction. In addition, the compressor disks adjacent to each other are disposed such that facing surfaces of adjacent compressor disks are pressed by the tie rod so that the adjacent compressor disks cannot independently rotate.

A plurality of compressor blades is radially coupled to an outer circumferential surface of each of the compressor disks. In addition, a plurality of compressor vanes which is mounted on an inner circumferential surface of the compressor casing and which is formed in an annular shape is disposed between the compressor blades on the basis of respective stages. Unlike the compressor disks, the compressor vanes are in a fixed state such that the compressor vanes do not rotate. Furthermore, the compressor vanes are configured to align a flow of compressed air that has passed through the compressor blades which are positioned at the upstream side, and are configured to guide the compressed air to the compressor blades which are positioned at the downstream side. Here, in order to distinguish both the compressor casing and the compressor vanes from the compressor rotors, both the compressor casing and the compressor vanes may be comprehensively defined as a compressor stator.

The tie rod is disposed such that the tie rod passes through center portions of the plurality of compressor disks and center portions of the turbine disks that will be described later. Furthermore, a first side end portion of the tie rod is fastened to an inside of the compressor disk that is positioned at the foremost side of the compressor 2, and a second side end portion of the tie rod is fastened by a fixing nut.

A shape of the tie rod is not limited to the shape illustrated in FIG. 1, and the tie rod may be formed in various structures according to the gas turbine. That is, a shape in which one tie rod is passing through the center portions of the compressor disks and the center portions of the turbine disks may be realized, another shape in which a plurality of tie rods is arranged in a circumferential direction may be realized, or a combination of the two shapes described above may be realized.

Although not illustrated, a deswirler functioning as a guide vane may be mounted in the compressor 2 of the gas turbine 1, in which the deswirler is configured to increase a pressure of fluid flowing into an inlet of the combustor 10 and is configured to adjust a flow angle of the fluid to a designed flow angle.

Figure 2:
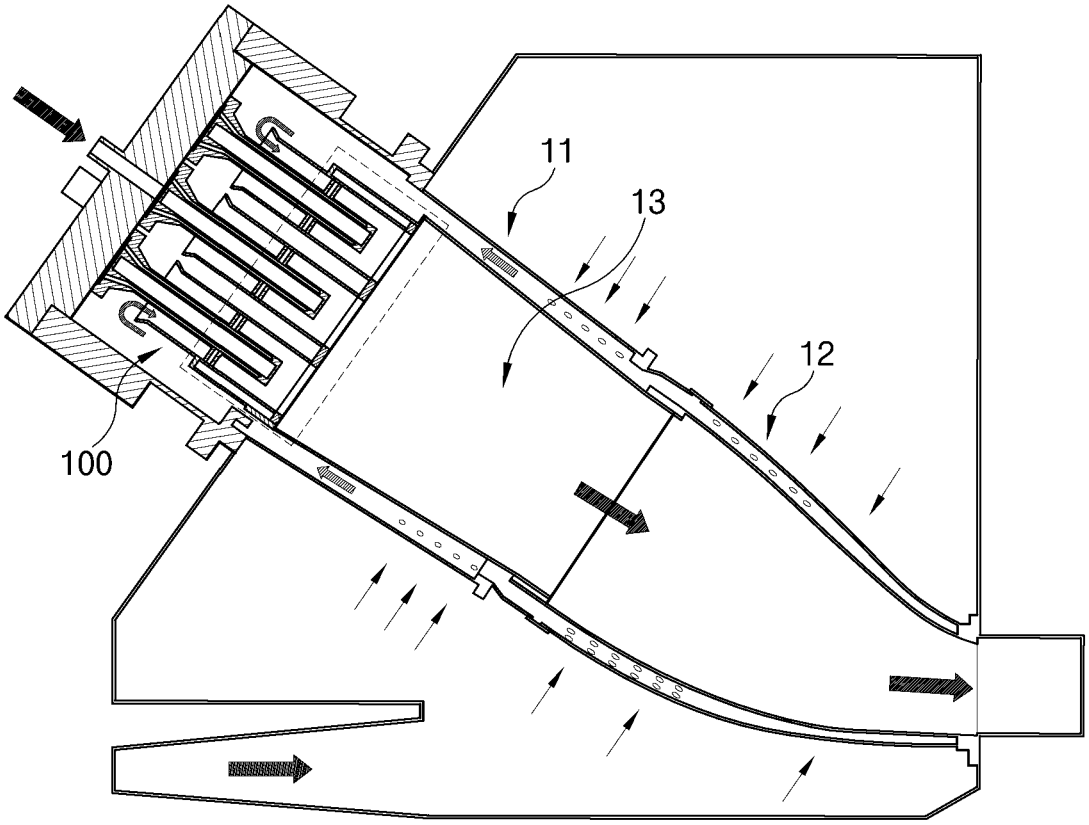
FIG. 2 is a cross-sectional view illustrating a combustor illustrated in FIG. 1.

FIG. 2 is a cross-sectional view illustrating a combustor illustrated in FIG. 1.

Referring to FIG. 2, the combustor 10 mixes introduced compressed air with fuel, combusts the fuel mixture to generate high-temperature and high-pressure combustion gas having high energy, and increases, through an isobaric combustion process, the temperature of the combustion gas to a heat-resistant temperature limit that components of the combustor 10 and components of the turbine 3 can endure.

The combustor 10 constituting a combustion system of the gas turbine 1 may include a plurality of combustors 10 arranged in a combustor casing formed in a cell shape. Each of the combustors 10 includes a nozzle assembly 100 for ejecting fuel, a liner 11 forming a combustion chamber 13, and a transition piece 12 serving as a connection portion between the combustor 10 and the turbine 3.

Specifically, the liner 11 provides a combustion space in which fuel ejected from the nozzle assembly 100 is mixed with compressed air from the compressor 2 and then combusted. In the liner 11, the combustion chamber 13 providing the combustion space in which the fuel mixed with air is combusted is formed, and a liner annular channel forming an annular space surrounding the combustion chamber 13 is formed. In addition, the nozzle assembly 100 for ejecting fuel is coupled to a front end of the liner 11, and an igniter is coupled to a side wall of the liner 11.

Compressed air introduced through a plurality of holes formed in an outer wall of the liner 11 flows in the liner annular channel. Furthermore, compressed air used to cool the transition piece 12 that will be described later also flows through the liner annular channel. As such, since compressed air flows along an outer wall portion of the liner 11, the liner 11 may be prevented from being thermally damaged by heat generated by the combustion of fuel in the combustion chamber 13.

The transition piece 12 is connected to a rear end of the liner 11 so that combustion gas combusted by an ignition plug is capable of being transferred toward the turbine 3. Similar to the liner 11, the transition piece 12 has a transition piece annular channel surrounding an internal space of the transition piece 12. Furthermore, an outer wall of the transition piece 12 is cooled by compressed air flowing along the transition piece annular channel so that the transition piece 12 is prevented from being damaged due to high-temperature of the combustion gas.

Meanwhile, referring to FIG. 1, the high-temperature and high-pressure combustion gas discharged from the combustor 10 is supplied into the turbine 3 that is described above. High-temperature and high-pressure combustion gas supplied into the turbine 3 expands while passing through an inner portion of the turbine 3, thereby applying impulsive force and reaction force to turbine blades so that rotational torque is generated. The rotational torque obtained in this manner is transmitted to the compressor 2 via the torque tube described above, and an additional rotation torque in excess of the torque required to drive the compressor 2 is used to drive a generator and so on.

The turbine 3 basically has a structure similar to that of the compressor 2. That is, the turbine 3 is also provided with a plurality of turbine rotors similar to the compressor rotors of the compressor 2. Therefore, each turbine rotor also includes a turbine disk and a plurality of turbine blades radially disposed around the turbine disk. A plurality of turbine vanes which is mounted in the turbine casing and which is disposed in an annular shape is provided between the turbine blades on the basis of respective stages. Furthermore, the turbine vanes guide the flow direction of the combustion gas passing through the turbine blades. Here, in order to distinguish the turbine casing and the turbine vanes from the turbine rotor, the turbine casing and the turbine vanes may be comprehensively defined as a turbine stator.

Figure 3:
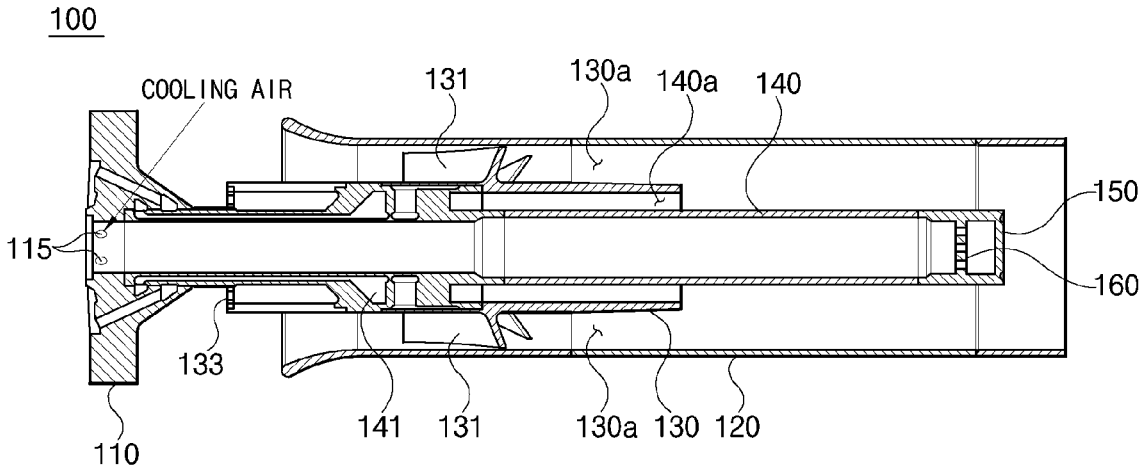
FIG. 3 is a cross-sectional view illustrating a nozzle assembly illustrated in FIG. 1.
Figure 4:
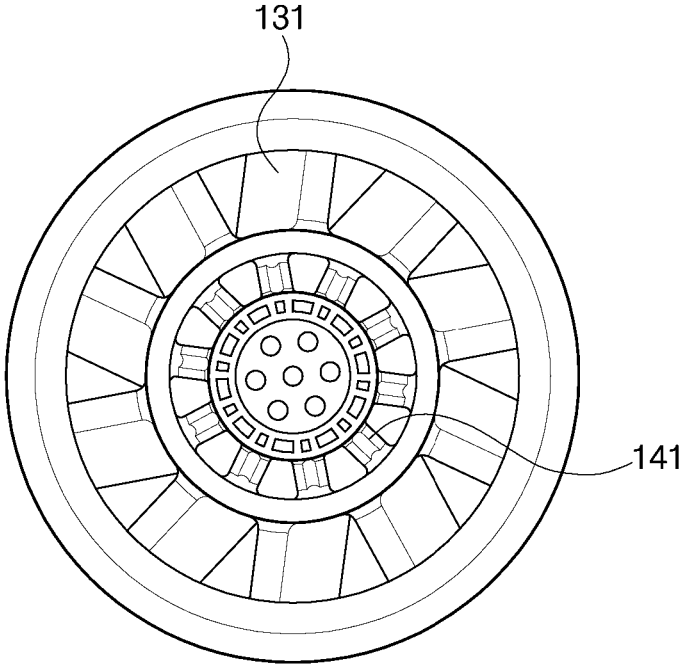
FIG. 4 is a view illustrating a structure of a swirler that is a component illustrated in FIG. 3.
Figure 5:
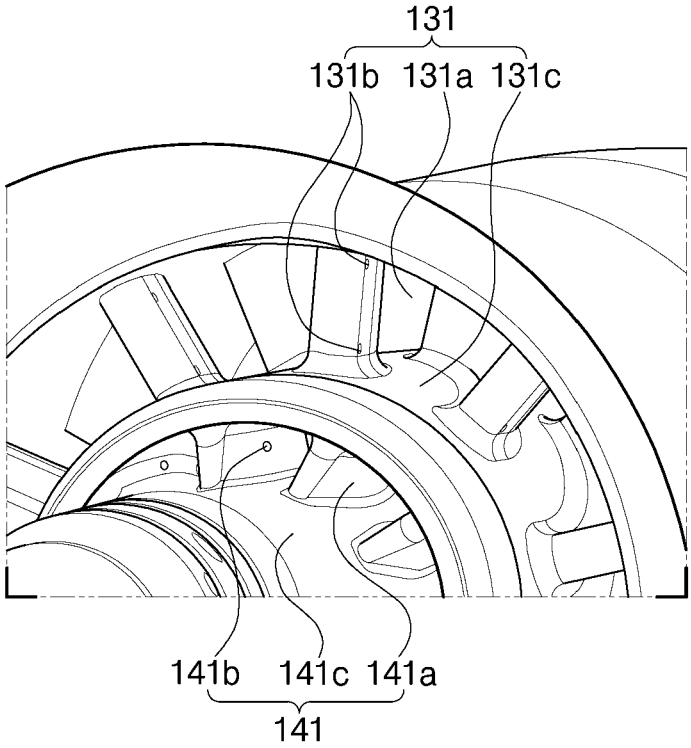
FIG. 5 is an enlarged view of FIG. 4.
Figure 6A:
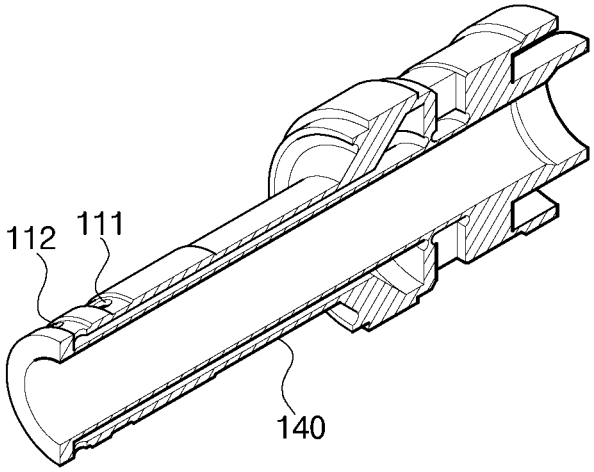
FIGS. 6A and 6B show an arrangement structure of a fuel supply flow path in FIG. 3.
Figure 6B:
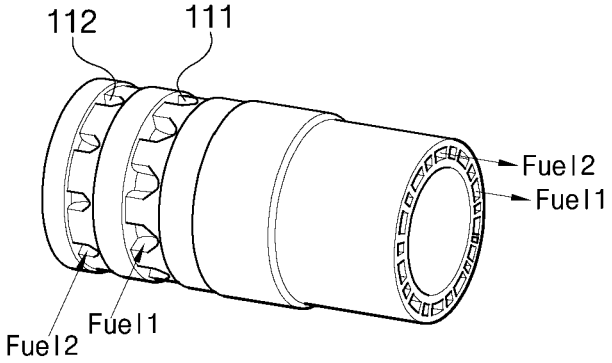
Figure 7:
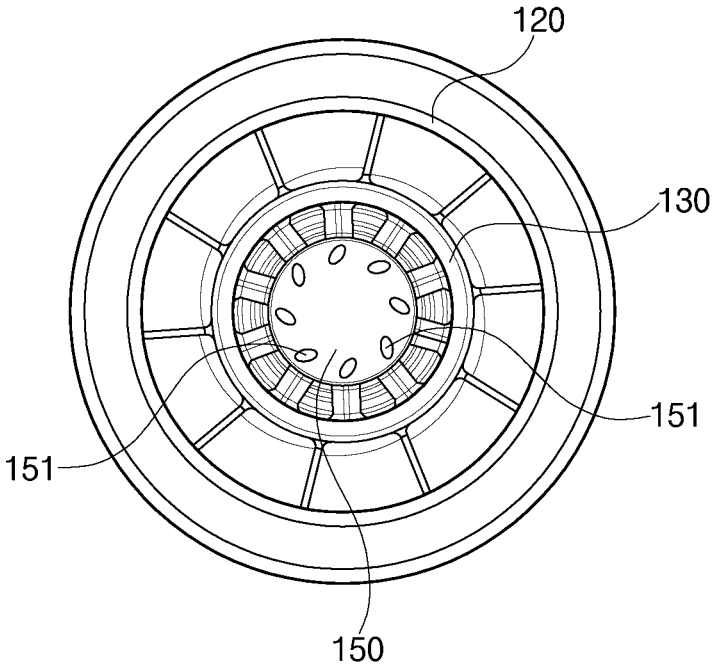
FIG. 7 is a view illustrating a structure of a bluff body that is a component illustrated in FIG. 3.
Figure 8:
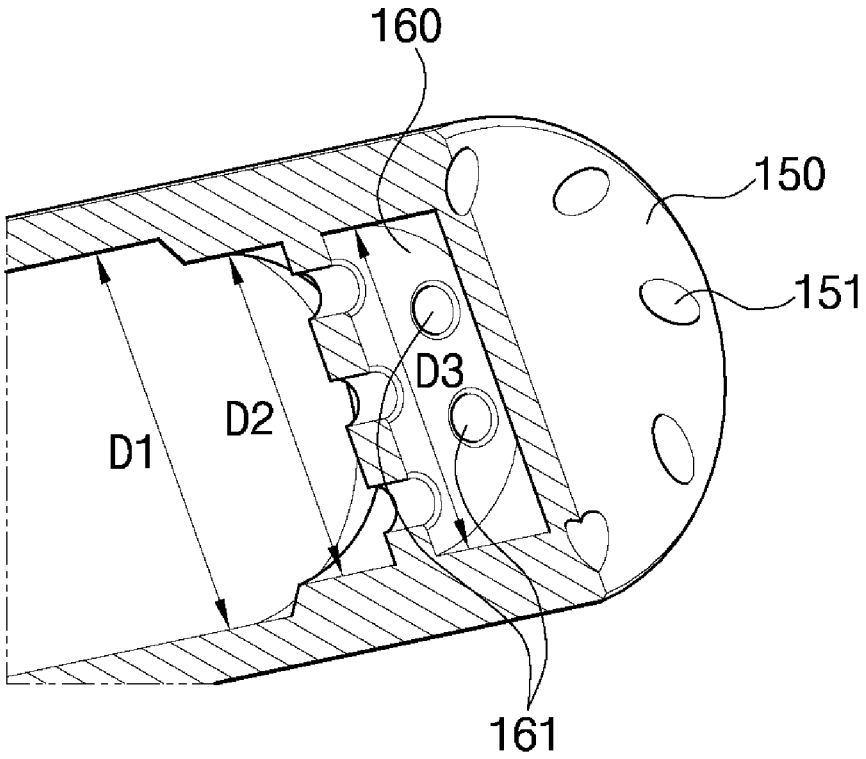
FIG. 8 is a cross-sectional view of FIG. 7.
Figure 9:
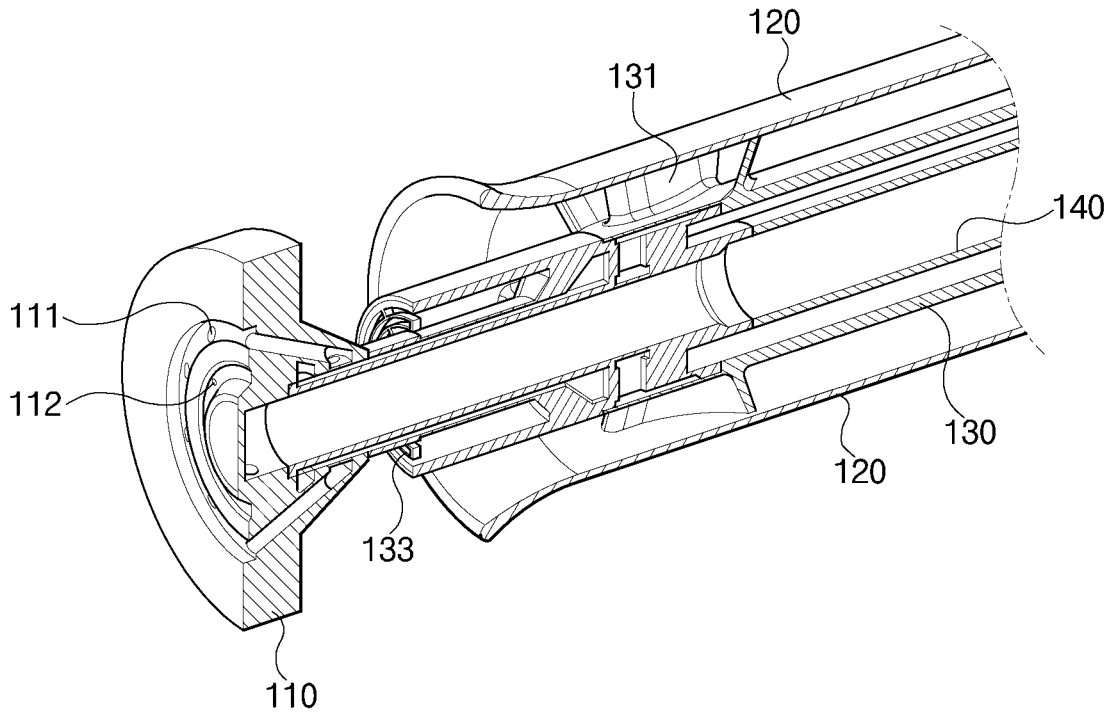
FIG. 9 is a rear cross-sectional view of FIG. 3.
Figure 10A:
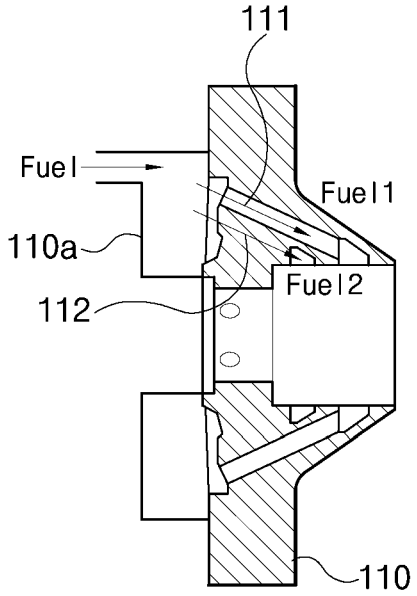
FIGS. 10A and 10B are enlarged views of FIG. 9.
Figure 10B:
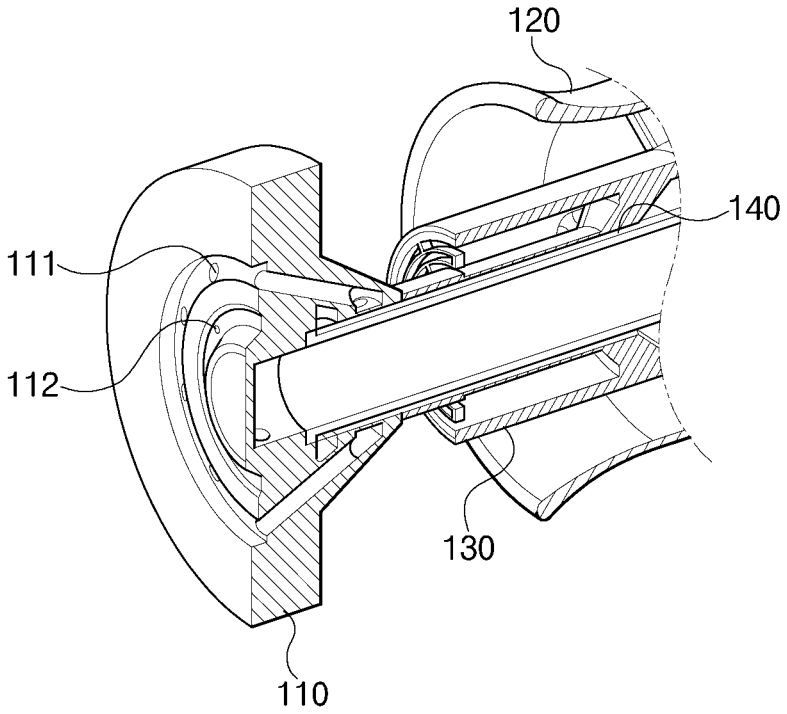

FIG. 3 is a cross-sectional view illustrating a nozzle assembly 100 illustrated in FIG. 1, FIG. 4 is a view illustrating a structure of a swirler that is a component illustrated in FIG. 3, FIG. 5 is an enlarged view of FIG. 4, FIGS. 6A and 6B show an arrangement structure of a fuel supply flow path in FIG. 3, FIG. 7 is a view illustrating a structure of a bluff body that is a component illustrated in FIG. 3, FIG. 8 is a cross-sectional view of FIG. 7, FIG. 9 is a rear cross-sectional view of FIG. 3, and FIGS. 10A and 10B are enlarged views of FIG. 9.

Referring to FIGS. 3 to 10, the nozzle assembly 100 according to the present disclosure may include a nozzle flange 110, a nozzle shroud 120, a first main cylinder 130, a first swirler 131, a second main cylinder 140, and a second swirler 141. The nozzle shroud 120 is formed elongated toward the combustion chamber 13 and are perpendicular to the combustion chamber 13. The nozzle flange 110, the nozzle shroud 120, the first main cylinder 130 and the second main cylinder 140 are concentric and share a same central axis.

The direction in which the nozzle shroud 120 is elongated may be referred to as an axial direction or longitudinal direction. Throughout the specification, the axial direction from the nozzle assembly 100 toward the combustion chamber 13 is referred to as downstream and its opposite direction is referred to as upstream. The upstream side may be referred to as front side and the downstream side may be referred to as the rear side.

The nozzle flange 110 is a member having a circular plate shape perpendicular to the longitudinal direction and receives fuel from the outside.

The nozzle flange 110 may be provided with a plurality of fuel supply flow paths 111, 112, and a supplied fuel may be distributed to the first swirler 131 and the second swirler 141.

The nozzle flange 110 is connected to a fuel supply portion 110*a*, and fuel supplied from the fuel supply portion 110*a* may be distributed along a first fuel supply flow path 111 and a second fuel supply flow path 112 that are formed in the nozzle flange 110.

At this time, each of the first fuel supply flow path 111 and the second fuel supply flow path 112 may be provided with a plurality of first fuel supply flow paths 111 and a plurality of second fuel supply flow paths 112. Furthermore, the first fuel supply flow path 111 may be connected to the first swirler 131 and the second fuel supply flow path 112 may be connected to the second swirler 141. Each of the plurality of the first fuel supply flow paths 111 and each of the plurality of the second fuel supply flow paths 112 are separate flow paths, not intersecting each other.

As an embodiment, each of the first fuel supply flow paths 111 may be spaced apart from each other by a predetermined distance in circumferential direction and each of the second fuel supply flow paths 112 may be spaced apart from each other by a predetermined distance in the circumferential direction. The circumferential direction is defined based on a central axis of the nozzle assembly 100. Fuel supplied through the first fuel supply flow path 111 and fuel supplied through the second fuel supply flow path 112 flow along the first fuel supply flow path 111 and the second fuel supply flow path 112, respectively. The first fuel supply flow path 111 and the second fuel supply flow path 112 extend to the second main cylinder 140. Furthermore, the fuel flowing along the first fuel supply flow path 111 is moved to the first swirler 131 and the fuel flowing along the second fuel supply flow path 112 is moved to the second swirler 141.

According to an embodiment, each first fuel supply flow path 111 may has a first inclined portion and a first axial portion. The first inclined portion of the first fuel supply flow path 111 may be inclined radially inwardly toward the downstream direction. In each first fuel supply flow path 111, the fuel may be supplied into the first inclined portion, then move through the first axial portion, and then move to the first swirler 131.

Similarly, each second fuel supply flow path 112 may has a second inclined portion and a second axial portion. The second inclined portion of the second fuel supply flow path 112 may be inclined radially inwardly toward the downstream direction. In each second fuel supply flow path 112, the fuel may be supplied into the second inclined portion, then move through the second axial portion, and then move to the second swirler 141.

The upstream end of the first inclined portion and the upstream end of the second inclined portion are formed, in a shape of a hole, on an upstream end of the nozzle flange 110. In the upstream end of the nozzle flange 110, the upstream end of the first inclined portion may be disposed relatively radially outward than the upstream end of the second inclined portion. At the same time, the upstream ends of the first inclined portions of the first fuel supply flow paths 111 and the upstream ends of the second inclined portions of the second fuel supply flow paths 112 are alternately arranged in the circumferential direction.

The downstream ends of the first inclined portions and the downstream ends of the second inclined portions are located in a same radial distance from the central axis of the nozzle assembly 100 and are alternately arranged in the circumferential direction. The downstream ends of the first inclined portions are located axially more downstream than the downstream ends of the second inclined portions.

According to an embodiment, the first axial portions of the first fuel supply flow paths 111 and the second axial portions of the second fuel supply flow paths 112 may be formed in the second main cylinder 140. In other words, the first axial portions of the first fuel supply flow paths 111 and the second axial portions of the second fuel supply flow paths 112 may be formed between an inner surface of the second main cylinder 140 and an outer surface of the second main cylinder 140.

According to an embodiment, a cross-sectional area of the upstream end of the first inclined portion and a cross-sectional area of the upstream end of the second inclined portion are different in their area sizes when viewed in the axial direction. Similarly, a cross-sectional area of the first axial portion and a second cross-sectional area of the second axial portion are different in their area sizes when viewed in the axial direction.

At this time, the amount of fuel distributed to the first fuel supply flow path 111 and the second fuel supply flow path 112 is determined by the sum of the respective areas of the flow paths. As a pressure from the fuel supply portion 110*a* is uniformly applied on the fuel, the sum of the amount of fuel flowing to the first swirler 131 and the amount of fuel flowing to the second swirler 141 may be determined by the respective areas of the flow paths. Accordingly, from the nozzle flange 110 supplying the entire fuel, a predetermined amount of fuel is supplied to the first fuel supply flow path 111 and the second fuel supply flow path 112 by using an area ratio, so that the amount of fuel is capable of being controlled by using one fuel control valve.

The nozzle shroud 120 is a member having a hollow cylindrical shape and is disposed at a side of the nozzle flange 110 toward the combustion chamber 13. The upstream end of the nozzle shroud 120 is spaced apart from the nozzle flange 110 in the longitudinal direction. In addition, a second side end portion (i.e., an upstream end portion) of the nozzle shroud 120 may have a curved surface. Such a curved structure of the second side end portion of the nozzle shroud 120 guides compressed air supplied from the compressor 2 to a first main flow path 130*a* so that air is uniformly supplied. Throughout the specification, a first side indicates a downstream side, and a second side indicates an upstream side.

The first main cylinder 130 is a member having a hollow cylindrical shape and having a diameter smaller than a diameter of the nozzle shroud 120. In addition, the first main cylinder 130 is disposed inside the nozzle shroud 120 in a radial direction such that a central axis of the main cylinder 130 coincides with a central axis of the nozzle shroud 120. The downstream end of the first main cylinder 130 is located relatively upstream than the downstream end of the nozzle shroud 120. The first main flow path 130*a* is formed between the first main cylinder 130 and the nozzle shroud 120.

The second main cylinder 140 is a member having a hollow cylindrical shape and having a diameter smaller than the diameter of the first main cylinder 130. The second main cylinder 140 is disposed inside the first main cylinder 130 in a radial direction such that a central axis of the second main cylinder 140 coincides with the central axis of the first main cylinder 130. The second main flow path 140*a* may be formed between the first main cylinder 130 and the second main cylinder 140. In other words, the second main flow path 140*a* is formed by an inner side surface of the first main cylinder 130 and an outer side surface of the second main cylinder 140.

A perforated plate 133 may be disposed at a second side end portion (i.e., an upstream end portion) of the main cylinder 130.

Specifically, the perforated plate 133 may be disposed on a second main flow path 140*a* and may be disposed on an inlet of the second main flow path 140*a* where compressed air is introduced into the second main flow path 140*a*. The perforated plate 133 is configured such that compressed air introduced into the second main flow path 140*a* is uniformly supplied, thereby being capable of improving mixing characteristics. There is no limitation in a shape of the perforated plate 133, and may be formed in various structures such as a grid shape, a band shape, a radial shape, and so on.

Referring to FIGS. 4 and 5, the first swirler 131 may be disposed between the nozzle shroud 120 and the first main cylinder 130. The first swirler 131 may include a first swirl cylinder 131*c* and a plurality of first swirl vanes 131*a*. The first swirl cylinder 131*c* is a member having a cylindrical shape and may have a diameter same as the diameter of the first main cylinder 130. In addition, the first swirl cylinder 131*c* may be formed integrally with the first main cylinder 130.

The first swirl vane 131*a* may include the plurality of first swirl vanes 131*a*, and the first swirl vanes 131*a* may be spaced apart from each other along a circumferential direction of the first swirl cylinder 131*c*. A plurality of first fuel holes 131*b* may be formed in the first swirl vane 131*a*. The fuel supplied from the first fuel supply flow path 111 is discharged through the first fuel holes 131*b*. The first swirl vane 131*a* is arranged such that the first swirl vane 131*a* has an angle (being inclined toward the circumferential direction), which creates a vortex is formed in the flow of compressed air and fuel introduced from an upstream side thereof. This vortex helps to evenly mix the compressed air and the fuel before it is supplied to the first main flow path 130*a*.

The second swirler 141 may include a second swirl cylinder 141*c* and a plurality of second swirl vanes 141*a*. The second swirl cylinder 141*c* is a member having a cylindrical shape and having a diameter same as the diameter of the second main cylinder 140 and may be coupled to the second main cylinder 140. According to an embodiment, the second swirl cylinder 141*c* may be formed integrally with the second main cylinder 140.

The second swirl vane 141*c* may include the plurality of second swirl vanes 141*c*. The second swirl vanes 141*a* may be disposed on an outside of the second swirl cylinder 141*c* such that the second swirl vanes 141*a* are spaced apart from each other along a circumferential direction. A plurality of second fuel holes 141*b* may be formed in the second swirl vanes 141*a* . The fuel supplied from the second fuel supply flow path 112 is discharged through the second fuel holes 141*b*. The second swirl vanes 141*a* may be rectilinearly disposed in the axial direction.

The first swirler 131 applies a rotational flow to fuel and air from a front end of the combustion chamber, and the second swirler 141 induces an axial flow in order to correct or mitigate any non-uniformity in mixing of fuel and air that may arise due to variations in their velocities.

The first fuel supply flow path 111 and the second fuel supply flow path 112 may be alternatively disposed in the circumferential direction on one region of a second side of the second main cylinder 140, i.e., one region inside a portion of the second main cylinder 140 connected to the nozzle flange 110. Fuel introduced through the nozzle flange 110 is distributed and moved to the first fuel supply flow path 111 and the second fuel supply flow path 112. Here, the first fuel supply flow path 111 and the second fuel supply flow path 112 are formed by extending in the axial direction in the second main cylinder 140 and are alternately arranged in the circumferential direction. Fuel moving through the first fuel supply flow path 111 may be moved to the first swirler 131 and may be ejected through the first fuel holes 131*b* formed in the first swirl vanes 131*a*, and fuel moving along the second fuel supply flow path 112 may be ejected through the second fuel holes 141*b* formed in the second swirl vanes 141*a*.

According to an embodiment, the first fuel supply flow paths 111 and the first swirlers 131 may fluidly communicate through the second swirl vanes 141*a* such that the fuel flowing in the first fuel supply flow path 111 flows to the first swirler 131 through the second swirl vanes 141*a*.

In the present disclosure, a structure in which the first swirler 131 and the second swirler 141 are separated from each other in the radial direction so as to improve the fuel-air mixing characteristics. In the first swirler 131, fuel supplied from the first fuel supply flow path 111 is mixed with compressed air. In the second swirler 141, fuel supplied from the second fuel supply flow path 112 is mixed with compressed air.

Here, the first main cylinder 130 may be disposed such that the first side end portion of the first main cylinder 130 is shorter than the first side end portion of the second main cylinder 140. In other words, the downstream end of the first main cylinder 130 is located relatively upstream than the downstream end of the second main cylinder 140. This is to secure a mixing space. That is, the first swirl vanes 131*a* have angles in the circumferential direction. This configuration improves fuel-air mixing characteristics by promoting the thorough mixing of fuel and air supplied to the second swirler 141 through a rotational flow generated by the first swirler 131.

Since the first main cylinder 130 has a shape shorter than the second main cylinder 140 in the longitudinal direction, a space is created where fuel and air moving the first main flow path 130*a* and fuel and air moving the second main flow path 140*a* are combined and mixed . The increase in fuel-air mixing characteristics is facilitated by the rotational flow of the fuel and the air generated by swirler 131.

As an embodiment, in order to increase mixing efficiency, the first main cylinder 130 may be provided such that the first main cylinder 130 has a diameter smaller than an inner diameter of the nozzle shroud 120 on the basis of an end portion of the nozzle shroud 120.

In addition, according to an embodiment, a cooling air inlet flow path 115 may be formed in the nozzle flange 110, and cooling air moved through the cooling air inlet flow path 115 may be moved to the second main cylinder 140. Compressed air introduced through the cooling air inlet flow path 115 performs a cooling function, and may cool the second main cylinder 140 while moving, along a hollow of the second main cylinder 140, to an outlet side.

A bluff body 150 is provided at the first side end portion of the second main cylinder 140, and a plurality of bluff body cooling holes 151 may be provided in the bluff body 150.

The bluff body 150 has a plate-shaped structure and is positioned at the first side end portion (i.e., downstream end portion) of the second main cylinder 140, and the bluff body cooling holes 151 may be formed in a round hole or a slit type. In addition, the bluff body cooling holes 151 may be formed such that the bluff body cooling holes 151 are inclined.

As an embodiment, the plurality of bluff body cooling holes 151 may be disposed such that cooling air that is ejected has an inclination. That is, the plurality of bluff body cooling holes 151 may be formed being inclined in a circumferential direction from a radial direction. The plurality of bluff body cooling holes 151 may be disposed such that the bluff body cooling holes 151 are spaced apart from each other by a predetermined distance in the circumferential direction so that a uniform cooling effect is realized.

According to an embodiment, a collision plate 160 may be formed inside the bluff body 1510. The collision plate 160 may have a plurality of collision plate cooling holes 161. The collision plate 160 may be disposed in an internal space of the second main cylinder 140, located adjacent to the bluff body 150. The collision plate cooling holes 161, formed in the collision plate 160, may be spaced apart from each other by the predetermined distance. Cooling air introduced from the cooling air inlet flow path 115 flows in the second main cylinder 140 and collided with the collision plate 160. The cooling efficiency may be increased through such collision cooling.

According to an embodiment, when viewed in the axial direction, the collision plate cooling holes 161 may be disposed such that a center of the collision plate cooling holes 161 and a center of the bluff body cooling holes 151 do not coincide with each other. This arrangement will increase the cooling efficiency.

Referring to FIG. 8, the second main cylinder may comprise an interior diameter decreasing portion. In the interior diameter decreasing portion, the second main cylinder's interior diameter may gradually decrease toward downstream before the collision plate. The second main cylinder may comprise a first portion before the interior diameter deceasing portion, a second portion from the interior diameter decreasing portion to the collision plate, and a third portion from the collision plate to the bluff body. The first portion may have a constant first interior diameter, the second portion may have a constant second interior diameter, and the third portion may have a constant third interior diameter. The first interior diameter is larger than the second and third interior diameters. The second interior diameter and the third interior diameter may be equal to each other.

As described above, the embodiment of the present disclosure has been described in detail with reference to the accompanying drawings.

Although the embodiments of the present disclosure have been disclosed for illustrative purposes, those skilled in the art will appreciate that various modifications, additions and substitutions are possible, without departing from the scope and spirit of the present disclosure. Also, it is noted that any one feature of an embodiment of the present disclosure described in the specification may be applied to another embodiment of the present disclosure. As described above, the embodiments and the accompanying drawings disclosed in the present disclosure are provided for describing the present disclosure and are not intended to limit the technical ideas of the present disclosure. The technical ideas of the present disclosure are not limited to the embodiments and the drawings. The scope of the present disclosure should be construed as being covered by the scope of the appended claims, and all technical ideas falling within the scope of the claims should be construed as being included in the scope of the present disclosure.

The invention claimed is:

1. A nozzle assembly comprising:

a nozzle flange configured to receive fuel from outside;

a nozzle shroud disposed on a first side of the nozzle flange;

a first main cylinder disposed inside the nozzle shroud in a radial direction of the nozzle shroud, the first main cylinder forming a first main flow path and flowing a first air-fuel mixture between the nozzle shroud and the first main cylinder;

a first swirler mounted on the first main cylinder;

a second main cylinder configured to receive and flow cooling air therethrough and disposed inside the first main cylinder in a radial direction of the first main cylinder, the second main cylinder forming a second main flow path and flowing a second air-fuel mixture between the first main cylinder and the second main cylinder; and a second swirler mounted on the second main cylinder, wherein a plurality of fuel supply flow paths is formed in the nozzle flange, and a supplied fuel is distributed to the first swirler and the second swirler along the plurality of fuel supply flow paths, wherein the first main cylinder is disposed such that a first side end portion of the first main cylinder is shorter than a first side end portion of the second main cylinder, wherein a bluff body is provided at a first side end portion of the second main cylinder, and a plurality of bluff body cooling holes is formed in the bluff body, wherein a collision plate provided with a plurality of collision plate cooling holes is disposed inside the second main cylinder upstream and adjacent to the bluff body, wherein the second main cylinder comprises an interior diameter decreasing portion where the second main cylinder's diameter gradually decreases toward downstream before the collision plate such that the second main cylinder comprises a first portion before the interior diameter deceasing portion, a second portion from the interior diameter decreasing portion to the collision plate, and a third portion from the collision plate to the bluff body, the first portion having a constant first interior diameter, the second portion having a constant second interior diameter, the third portion having a constant third interior diameter, the first interior diameter being larger than the second and third interior diameters, the second interior diameter and the third interior diameter being equal.

2. The nozzle assembly of claim 1, wherein the plurality of fuel supply flow paths comprises a plurality of first fuel supply flow paths supplying the fuel to the first swirler and a plurality of second fuel supply flow paths supplying the fuel to the second swirler, and the first fuel supply flow paths are disposed to be spaced apart from each other by a predetermined distance in a circumferential direction and the second fuel supply flow paths are disposed to be spaced apart from each other by a predetermined distance in the circumferential direction.

3. The nozzle assembly of claim 2, wherein the amount of fuel distributed to the first fuel supply flow paths and the second fuel supply flow paths is determined by the sum of respective flow path areas.

4. The nozzle assembly of claim 1, wherein a second side end portion of the nozzle shroud is provided with a curved surface.

5. The nozzle assembly of claim 1, wherein a perforated plate is disposed in a second side end portion of the first main cylinder.

6. The nozzle assembly of claim 1, wherein a cooling air inlet flow path is formed in the nozzle flange, and the cooling air introduced through the cooling air inlet flow path is moved to the second main cylinder.

7. The nozzle assembly of claim 1, wherein the bluff body cooling holes are inclined.

8. A combustor configured to mix compressed air with fuel and to combust a mixture of the compressed air and the fuel, the combustor comprising:

a nozzle casing;

a liner connected to an end portion of the nozzle casing, the liner having an inner portion provided with a combustion chamber in which the mixture of the compressed air and the fuel is combusted;

a transition piece connected to an end portion of the liner, the transition piece being configured to supply the combustion gas generated from the combustion chamber to the turbine; and a nozzle assembly mounted inside the nozzle casing and configured to eject the fuel and the compressed air into the combustion chamber, wherein the nozzle assembly comprises:

a nozzle flange configured to receive fuel from outside;

a nozzle shroud disposed on a first side of the nozzle flange;

a first main cylinder disposed inside the nozzle shroud in a radial direction of the nozzle shroud, the first main cylinder forming a first main flow path and flowing a first air-fuel mixture between the nozzle shroud and the first main cylinder;

a first swirler mounted on the first main cylinder;

a second main cylinder configured to receive and flow cooling air therethrough and disposed inside the first main cylinder in a radial direction of the first main cylinder, the second main cylinder forming a second main flow path and forming a second air-fuel mixture between the first main cylinder and the second main cylinder; and a second swirler mounted on the second main cylinder, wherein a plurality of fuel supply flow paths is formed in the nozzle flange, and a supplied fuel is distributed to the first swirler and the second swirler along the plurality of fuel supply flow paths, wherein the first main cylinder is disposed such that a first side end portion of the first main cylinder is shorter than a first side end portion of the second main cylinder, wherein a bluff body is provided at a first side end portion of the second main cylinder, and a plurality of bluff body cooling holes is formed in the bluff body, wherein a collision plate provided with a plurality of collision plate cooling holes is disposed inside the second main cylinder upstream and adjacent to the bluff body, wherein the second main cylinder comprises an interior diameter decreasing portion where the second main cylinder's diameter gradually decreases toward downstream before the collision plate such that the second main cylinder comprises a first portion before the interior diameter deceasing portion, a second portion from the interior diameter decreasing portion to the collision plate, and a third portion from the collision plate to the bluff body, the first portion having a constant first interior diameter, the second portion having a constant second interior diameter, the third portion having a constant third interior diameter, the first interior diameter being larger than the second and third interior diameters, the second interior diameter and the third interior diameter being equal.

9. The combustor of claim 8, wherein a perforated plate is disposed in a second side end portion of the first main cylinder.

10. A gas turbine comprising:

a compressor configured to compress air introduced from outside;

a combustor configured to mix compressed air supplied from the compressor with fuel and to combust a mixture of the compressed air and the fuel; and a turbine configured to generate power for generating electric power by passing combustion gas supplied from the combustor to an inner portion of the turbine, wherein the combustor comprises:

a nozzle casing;

a liner connected to an end portion of the nozzle casing, the liner having an inner portion provided with a combustion chamber in which the mixture of the compressed air and the fuel is combusted;

a transition piece connected to an end portion of the liner, the transition piece being configured to supply the combustion gas generated from the combustion chamber to the turbine; and a nozzle assembly mounted inside the nozzle casing and configured to eject the fuel and the compressed air into the combustion chamber, wherein the nozzle assembly comprises:

a nozzle flange configured to receive fuel from the outside;

a nozzle shroud disposed on a first side of the nozzle flange;

a first main cylinder disposed inside the nozzle shroud in a radial direction of the nozzle shroud, the first main cylinder forming a first main flow path and flowing a first air-fuel mixture between the nozzle shroud and the first main cylinder;

a first swirler mounted on the first main cylinder;

a second main cylinder configured to receive and flow cooling air therethrough and disposed inside the first main cylinder in a radial direction of the first main cylinder, the second main cylinder forming a second main flow path and flowing a second air-fuel mixture between the first main cylinder and the second main cylinder; and a second swirler mounted on the second main cylinder, and wherein a plurality of fuel supply flow paths is formed in the nozzle flange, and a supplied fuel is distributed to the first swirler and the second swirler along the plurality of fuel supply flow paths, wherein the first main cylinder is disposed such that a first side end portion of the first main cylinder is shorter than a first side end portion of the second main cylinder, wherein a bluff body is provided at a first side end portion of the second main cylinder, and a plurality of bluff body cooling holes is formed in the bluff body, wherein a collision plate provided with a plurality of collision plate cooling holes is disposed inside the second main cylinder upstream and adjacent to the bluff body, wherein the second main cylinder comprises an interior diameter decreasing portion where the second main cylinder's diameter gradually decreases toward downstream before the collision plate such that the second main cylinder comprises a first portion before the interior diameter deceasing portion, a second portion from the interior diameter decreasing portion to the collision plate, and a third portion from the collision plate to the bluff body, the first portion having a constant first interior diameter, the second portion having a constant second interior diameter, the third portion having a constant third interior diameter, the first interior diameter being larger than the second and third interior diameters, the second interior diameter and the third interior diameter being equal.

* * * * *